United States Patent [19]

Petermann et al.

[11] 3,994,365

[45] Nov. 30, 1976

[54] APPARATUS FOR POSITIONING PERSON WITHIN CONTAINER TANK

[75] Inventors: James P. Petermann, Tigard; Frederick D. Helversen, Portland; Jack A. Thomas, Tigard, all of Oreg.

[73] Assignee: Georgia-Pacific Corporation, Portland, Oreg.

[22] Filed: Mar. 5, 1975

[21] Appl. No.: 555,417

Related U.S. Application Data

[63] Continuation-in-part of Ser. No. 520,771, Nov. 4, 1974.

[52] U.S. Cl. ..... 182/2; 182/36; 182/128; 182/142

[51] Int. Cl.[2] ..... E04G 3/10

[58] Field of Search ..... 182/2, 128, 150, 223, 182/222, 142, 152, 36, 37, 1, 129; 214/1 H; 52/749; 239/191

[56] References Cited

UNITED STATES PATENTS

| | | | |
|---|---|---|---|
| 2,057,217 | 10/1936 | Soper | 239/191 |
| 3,163,880 | 1/1965 | Johnson | 182/2 |
| 3,183,997 | 5/1965 | Kleiss | 182/150 |
| 3,306,396 | 2/1967 | Goss | 182/2 |
| 3,880,254 | 4/1975 | Fitzgerald | 182/2 |

FOREIGN PATENTS OR APPLICATIONS

| | | | |
|---|---|---|---|
| 281,711 | 8/1962 | Netherlands | 182/2 |

*Primary Examiner*—Reinaldo P. Machado
*Attorney, Agent, or Firm*—Klarquist, Sparkman, Campbell, Leigh, Hall & Whinston

[57] ABSTRACT

An apparatus for positioning a person within a container tank for inspection, cleaning, or repair of such tank is described. The apparatus includes a pivoted parallelogram type support having a cage enclosure at one end and a counter balance weight at the other end, such support being pivotally attached to a hoist member for movement of the cage toward and away from the tank wall while maintaining such cage upright. The hoist raises and lowers the support and cage within the tank and through a restricted opening in the tank when the support is pivoted into a retracted position. Bearing means is provided around the hoist stem for guiding vertical movement and enabling manual rotation of the hoist member and cage. A valve actuated cylinder is employed to control the pivoting of the support by manual actuation of the valve from within the cage. A work platform made of folding sections may be attached to the base of the cage, such sections beng folded for passing through the restricted opening and unfolded within the tank to provide additional working area around the cage. A high pressure water line extends down inside the hoist stem to a connector for connecting such line to a high pressure water spray device for cleaning the interior of the tank. The water line is also connected through a pressure reducing valve to the cylinder used to pivot the support member.

15 Claims, 7 Drawing Figures

FIG. 2
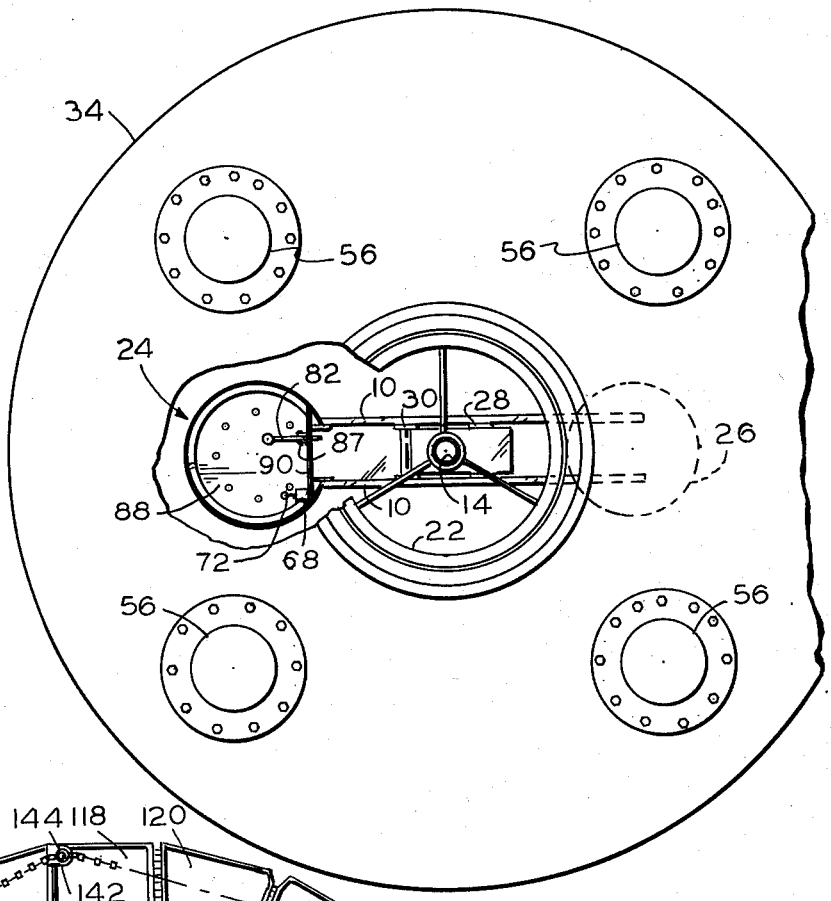
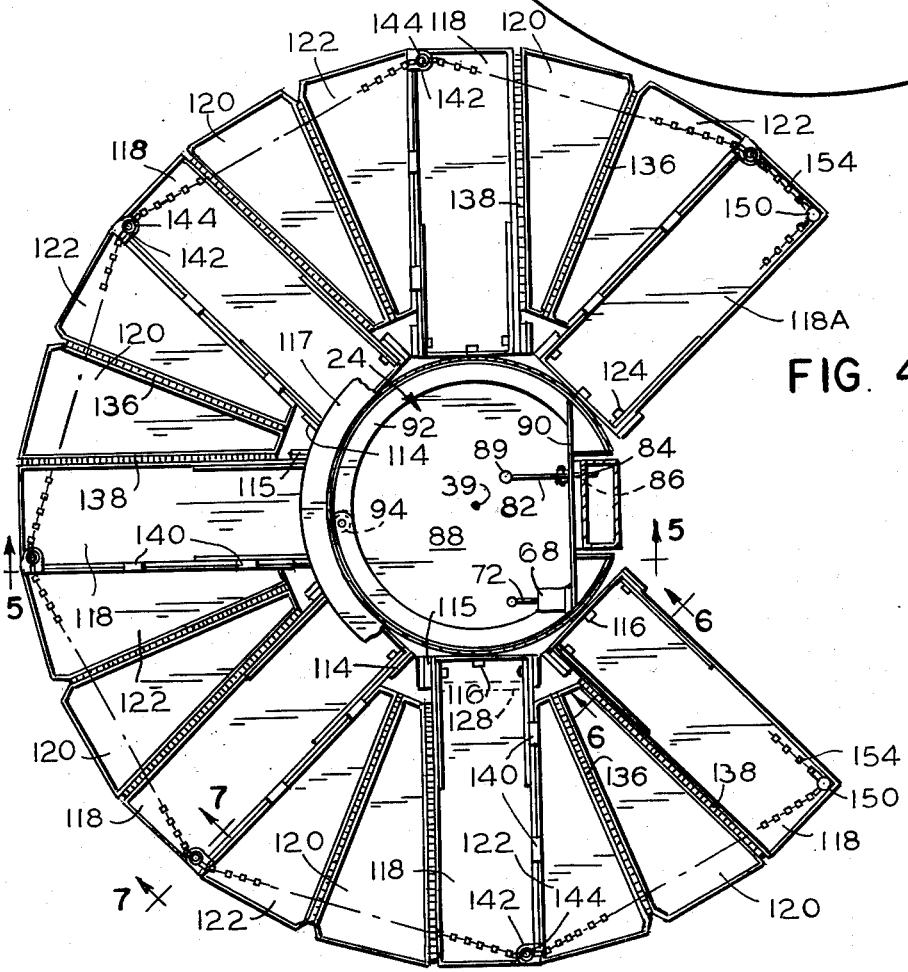
FIG. 4

FIG. 5
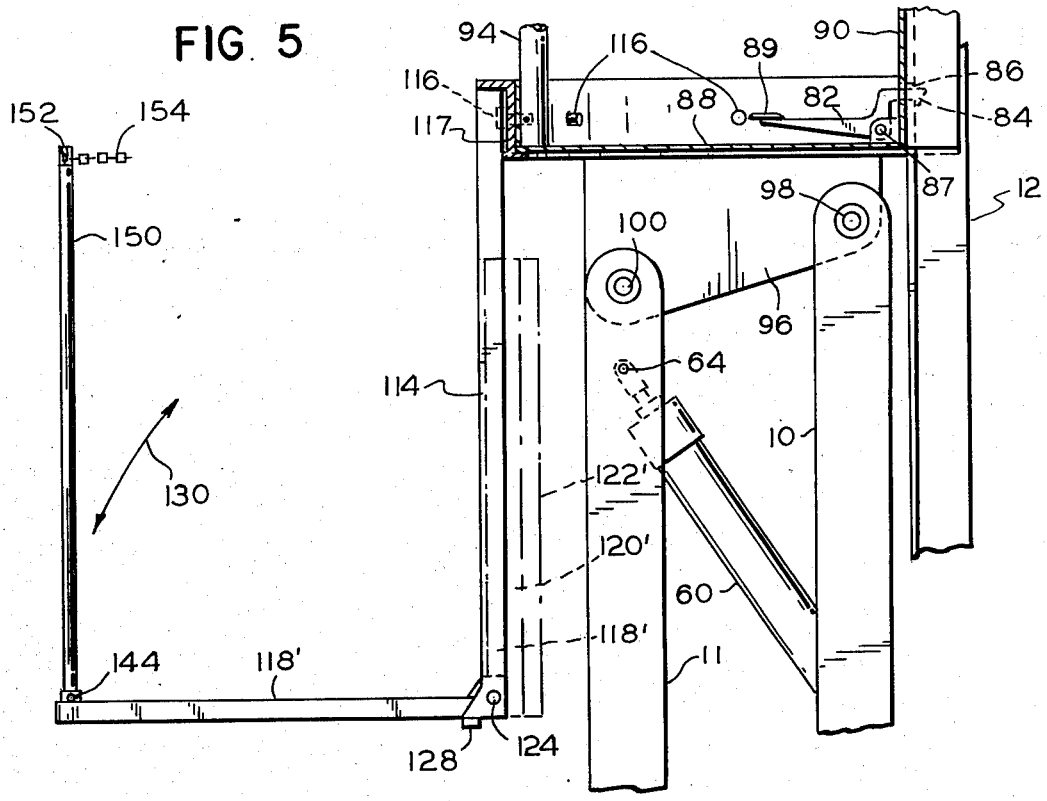
FIG. 6
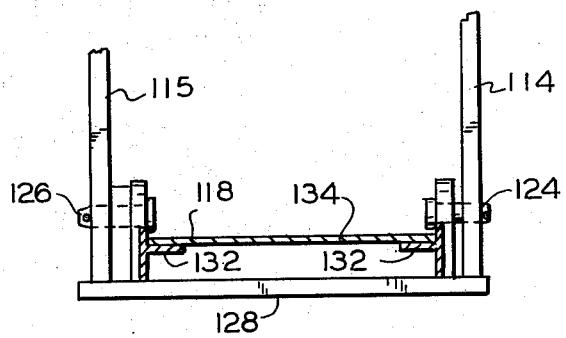
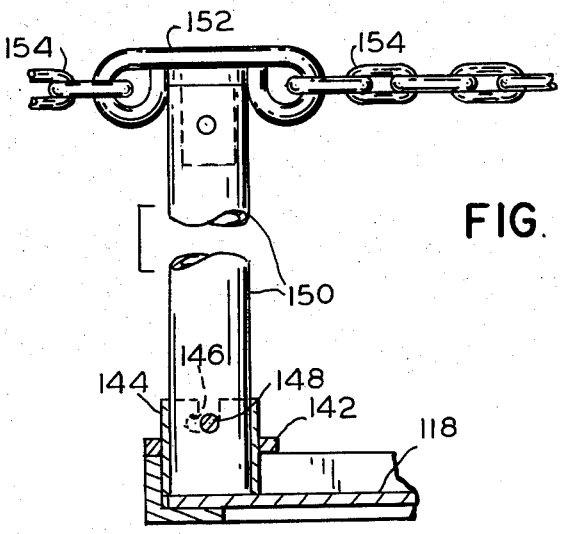
FIG. 7

APPARATUS FOR POSITIONING PERSON WITHIN CONTAINER TANK

REFERENCE TO RELATED APPLICATION

The present patent application is a continuation-in-part of copending U.S. patent application Ser. No. 520,771 filed Nov. 4, 1974 by J. P. Petermann et al on AUTOMATIC SPRAY CLEANING APPARATUS & METHOD.

BACKGROUND OF THE INVENTION

The subject matter of the present invention relates generally to apparatus for positioning a person in different positions by controlled movement of a cage enclosure mounted on a pivoted support, and in particular to such apparatus for positioning the person within a container tank and for transporting the support as well as the cage enclosure and folding platform attached thereto through a restricted opening in such tank. The apparatus of the present invention is especially useful in enabling manual inspection, cleaning, or repair of the interior of a container tank such as a chemical reactor tank.

The apparatus of the present invention has several advantages including the ability to mechanically transport a person into a container tank through a restricted opening in such tank to a desired position within the tank. It has the further advantage that it enables a person to adjust his position within the tank by operating a valve from within the cage enclosure to change the spacing of the cage from the tank wall and for limited movement vertically and horizontally in a simple, accurate manner. A relatively inexpensive control means including a valve actuated cylinder is provided for pivoting the cage into a desired position while maintaining it upright. In addition, a work platform may be provided around the base of the cage by folding platform sections which fold relative to the cage to a vertical position substantially parallel to the longitudinal axis of the cage for passing through the restricted opening and unfold into a horizontal position perpendicular to such axis to give a larger work area within the tank.

SUMMARY OF INVENTION

It is therefore one object of the present invention to provide an improved apparatus for supporting a person and moving him into different positions in a simple and inexpensive manner.

Another object of the invention is to provide such an apparatus which transports the person into a container tank through a restricted opening and positions him within such tank, to enable inspection, cleaning or repair of the interior of the tank more quickly and easily.

A further object of the invention is to provide such an apparatus with a simple, trouble free, and inexpensive means for moving a cage enclosure containing the person horizontally and vertically within the tank while maintaining the cage upright.

An additional object of the invention is to provide such an apparatus with a folding platform attached to the base of the cage which unfolds to provide a larger work area around the cage and folds to enable such platform to pass through the restricted opening in the container tank.

A still further object of the present invention is to provide such an apparatus in which the support for the cage enclosure is pivoted by a valve actuated cylinder connected to a high pressure water line which is also attached to a connector for a manually operated high pressure water spray cleaning device for cleaning the interior of the tank.

DESCRIPTION OF THE DRAWINGS

Other objects and advantages of the present invention will be apparent from the following detailed description of a preferred embodiment thereof and from the attached drawings of which:

FIG. 2 is a horizontal section view taken along line 2—2 of FIG. 1, with a portion of the container tank broken away;

FIG. 4 is a top plan view of an auxiliary work platform attached to the cage apparatus of FIGS. 1 to 3;

FIG. 5 is a horizontal section view taken along the line 5—5 of FIG. 4;

FIG. 6 is an enlarged section view taken along the line 6—6 of FIG. 4; and FIG. 7 is an enlarged section view taken along the line 7—7 of FIG. 4, with the top portion above the bracket rotated 90° for clarity.

DESCRIPTION OF PREFERRED EMBODIMENT

Figure 1:
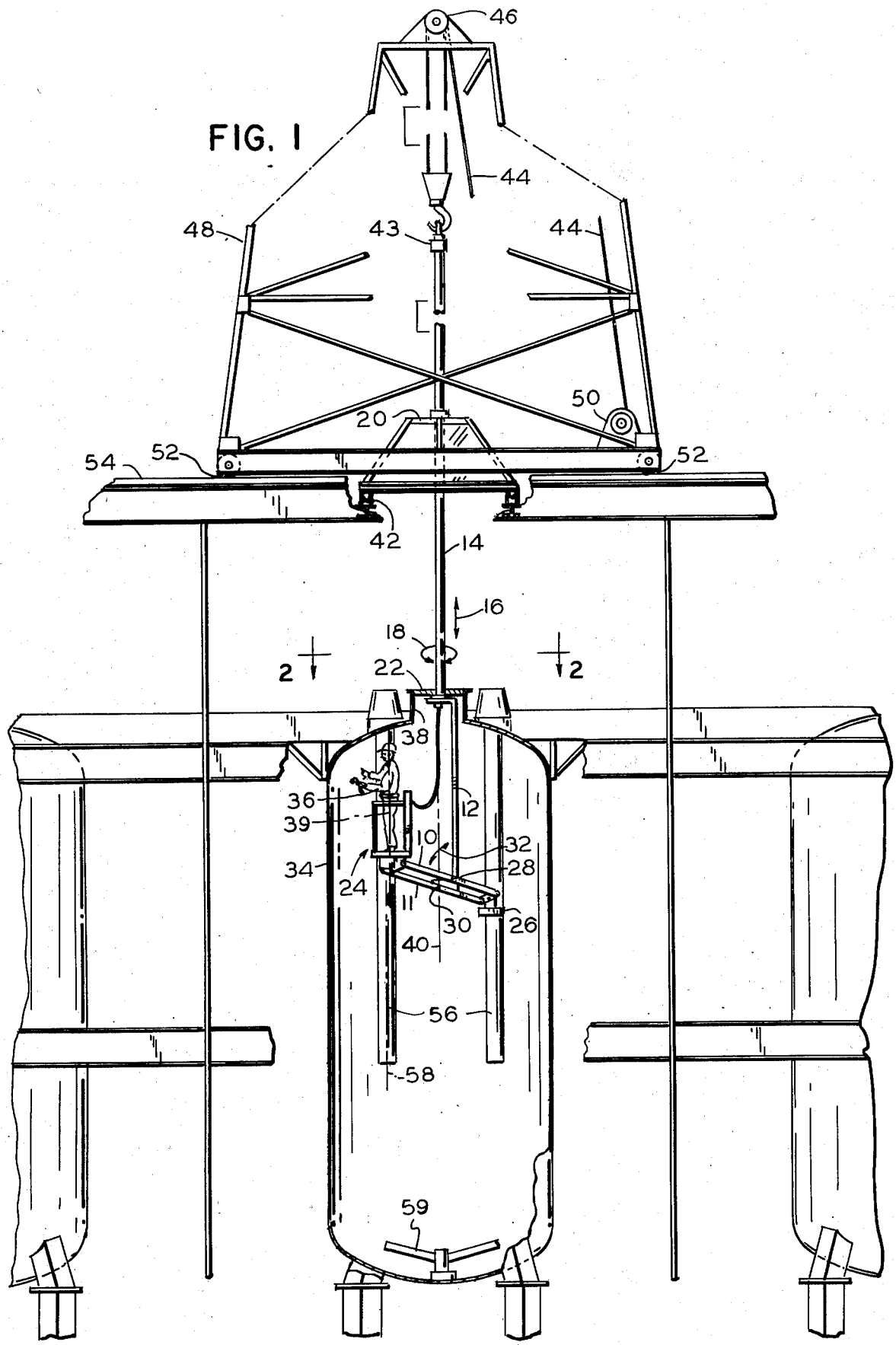
FIG. 1 is a side elevation view of the apparatus of the present invention with parts broken away for clarity to show the interior of the container tank.

As shown in FIG. 1, the positioning apparatus of the present invention includes a first pair of upper support arms 10 and a second pair of lower support arms 11, pivotally mounted on the lower end of a hoist member 12 whose upper end is secured to a hollow tubular hoist stem 14. The hoist stem 14 is mounted for vertical movement in the direction of arrows 16 and rotational movement in the direction of arrows 18 within an upper bearing unit 20 and a lower bearing unit 22 which act as vertical guides. A man cage enclosure 24 for enclosing a person is attached to one end of the support arms and a counter balance means 26, such as counter balance weights, is attached to the other end of the support arms on opposite sides of a pair of pivots 28 and 30 respectively attaching the support arms 10 and 11 to the hoist member 12 to enable pivoting movement in the direction of arrows 32. The positioning apparatus is shown within a container tank 34, which may be a chemical reactor tank, to enable a man 36, enclosed within the cage 34, to inspect, clean, or repair the interior of such tank.

A restricted opening 38 is provided through the upper end of the container tank 34 to enable access to the interior of the tank. The support arms 10 and 11 are pivoted to a retracted position substantially parallel to the longitudinal axis 39 of the cage to support the cage 24 and counterweight 26 adjacent to the hoist member 12 in substantial allignment with the axis 40 of the tank which is coaxial with the axis of hoist stem 14. This enables the positioning apparatus to be moved into and out of the tank 34 through the restricted opening 38 by raising and lowering the hoist member 12 in the direction of arrow 16.

When the positioning apparatus is positioned within the tank 34, the lower bearing unit 22 engages the periphery of the restricted opening 38 so that such bearing unit is supported on the tank. The upper bearing unit 20 is releasably mounted on a support ring 42 positioned above the container tank. The hoist stem 14 is attached at its top end to a swivel bearing 43 having an eye engaged by a hook on one end of a hoist cable 44 which extends around a block and tackle pulley 46 at the top of a derrick 48 and is coupled to the output shaft of a hoist motor 50 for raising and lowering the hoist members 12 and 14 in the direction of arrows 16. The hoist motor is mounted on the derrick and such derrick is provided with wheels 52 for rolling movement along a pair of rails 54 to enable it to be moved from one container tank to another, as described in application Ser. No. 520,777 previously referred to.

As shown in FIG. 2, the container tank 34 may be provided with 4 cooling probe baffles 56 which extend down through the top of the tank into the interior of such tank. Thus, the cooling probe baffles are in the form of internal cylindrical baffles which restrict movement of the man cage within the tank and must be avoided during pivoting and rotational movement of such cage in the direction of arrows 18 and 32. In addition, the chemical reactor tank 34 contains other internal obstructions which must be avoided, but are not shown for questions of simplicity. While the size of the container tanks vary, they are typically about 30 feet high and about 12 feet in diameter. The cooling probe baffles 56 each have their axis 58 spaced from the axis 40 of the tank approximately 4 feet. In the example given, the longitudinal axis 39 of the man cage 24 is spaced a distance of about 2 ½ feet from the axis 40 of the tank in the extended position of the support arms 10 and 11 shown in FIG. 1. In this extended position the outer edge of the cage 24 is about 3 ½ feet from axis 40 and will clear the probe baffles 56 during rotation of the cage and support arms 10 and 11 about the axis 40 in the direction of arrows 18. A ladder may be provided on the cage which enables the person 36 to climb out of the cage down onto the bottom of the tank for repair of the agitator 59.

The cage and support arm is manually rotated in the direction of arrows 18 by the person 36 within the cage, merely by pushing on the probe baffles or other internal obstructions. However, vertical movement in the direction of arrows 16 is accomplished by the hoist motor operator outside the tank who controls the operation of motor 50 on command of the person 36 within the cage, who communicates with such operator by telephone or other suitable means.

Figure 3:
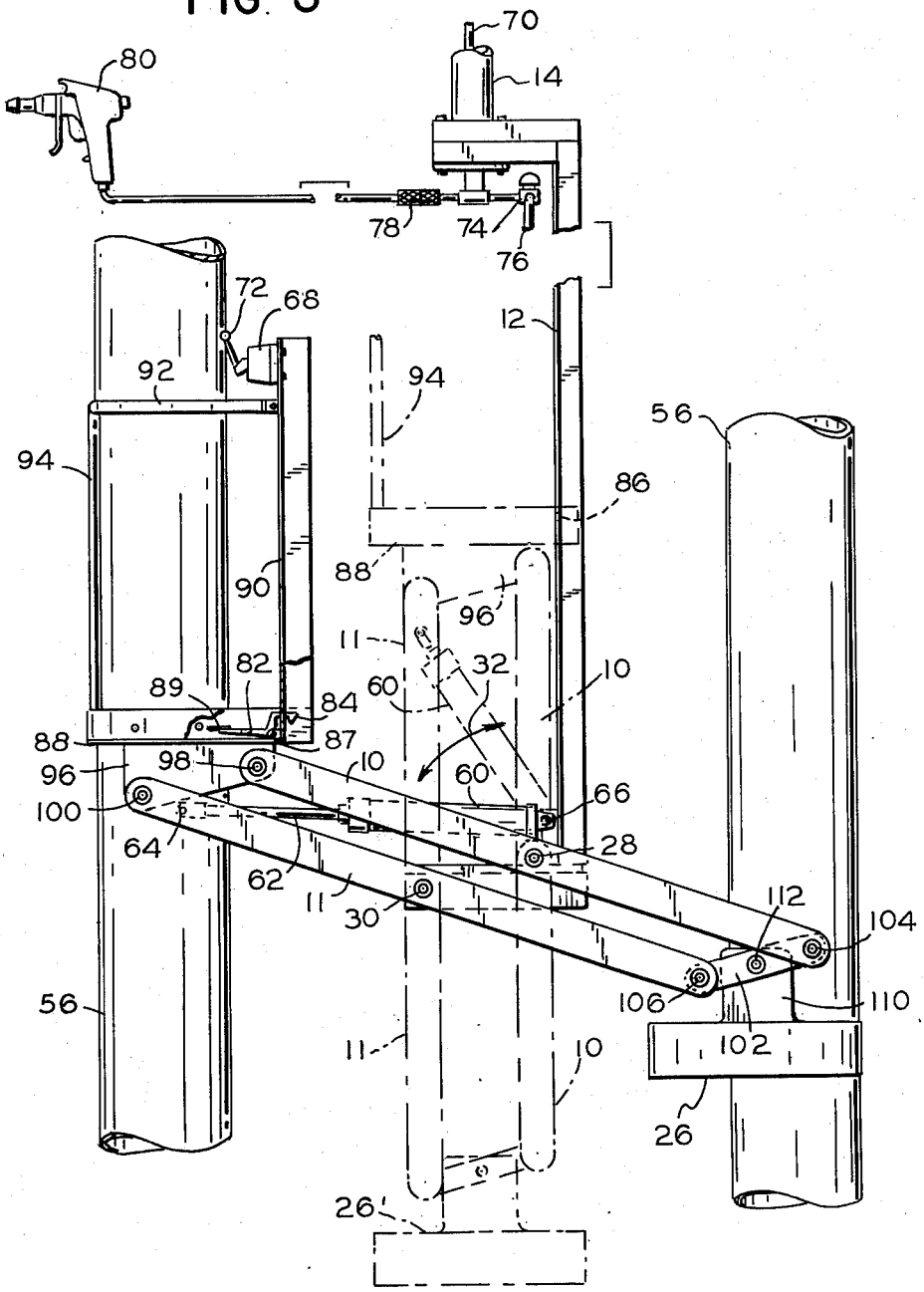
FIG. 3 is an enlarged side elevation view of a portion of the apparatus of FIG. 1 with a portion of the cage broken away for clarity.

As shown in FIG. 3, the support arms 10 and 11 are pivoted in the direction of arrows 32 by a hydraulic cylinder 60 whose piston rod 62 is pivotally connected at its outer end by pivot 64 to support arms 11 adjacent the cage 24, while the other end of the cylinder is pivotally connected to the hoist member 12 by pivot 66. A valve 68 is connected between cylinder 60 and a high pressure water line 70 extending down inside the hoist stem 14 for actuation of the cylinder in response to movement of a hand control lever 72 which opens and closes the valve from a position within the cage. A pressure reducing valve 74 is provided between the high pressure line 70 and a flexible hose 76 connecting such line to the cylinder control valve 68 in order to reduce the pressure from 5000 psi in line 70 to 1500 psi in hose 76. A connector 78 is provided on the end of the high pressure line 70 at the top of the hoist member 12 for connecting such line to a manually operated high pressure water spray cleaning device 80 which is employed by the person within cage 24 to clean the interior of the tank.

As shown in FIGS. 3 and 4, a foot operated latch means 82 is provided in the bottom of cage 24 for latching the cage to the hoist member 12 in the retracted position 24' shown in dash lines in FIG. 3. The latch means includes a spring biased latch member 84 which extends through a hole 85 in the cage backing and engages the periphery of a latch opening 86 provided in the side of the hoist member 12. The latch is mounted on a pivot 87 and is released by stepping on the latch peddle 89 to pivot latch member 82 upward so that it releases and may be retracted out of the latch opening 86.

The cage enclosure 24 includes a support base 88 and a back member 90 secured thereto, a hand railing 92 which is attached at its opposite ends to the back plate 90, and is supported intermediate its ends by a post 94 mounted on base 88. The base 88 has a bottom projection portion 96 to which the support arms 10 and 11 are pivotally attached by pivots 98 and 100 respectively at one end of such arms. The other ends of the support arms 10 and 11 are pivotally attached to a link 102 at pivots 104 and 106. Link 102 is also pivotally attached by pivot 112 to an upper projection 110, extending from the top of the counter weight 26. It should be noted that the distance between the centers of pivots 104 and 106 is equal to the distance between the centers of pivots 98 and 100 and the support arms 10 and 11 are of the same length so that they form a parallelogram type support means which maintains the cage 24 is an upright position in all pivot positions of such arms during pivoting in the direction of arrows 32.

As shown in FIGS. 4 and 5, a work platform may be provided which is supported on the base 88 of the cage 24 in the retracted position of the cage, by a plurality of pairs of pivot arms 114 and 115. The pivot arms 114 and 115 are secured at their upper ends to a support ring 117 which is releasably attached to the cage by attachment pins 116 extending through aligned apertures in the ring and in base member 88 and secured by cotter keys in the end of such pins. The work platform is in the form of a plurality of platform sections each including a main platform panel 118 and two folding platform panels 120 and 122. The main platform panel 118 is attached by a pair of pivots 124 and 126 to the lower ends of the pivot arms 114 and 115 respectively. The lower ends of the two pivot arms 114 and 115 are joined together by a stop bar 128 which limits the pivoting movement of the main platform section 118 in the direction of arrows 130 and holds it in the horizontal position shown in FIG. 5. It should be noted that the main platform panels 118 and the hinged panels 120 and 122 are all pivoted upward into a retracted vertical position 118', 120', and 122' to enable the work platform to pass through the restricted opening 38 in the top of the container tank. Once the work platform is inside the container tank, it is unfolded in sections into the solid line position shown in FIGS. 3 and 4.

As shown in FIG. 6, each of the main platform panels 118 includes a pair of T shaped cross section frame members 132 which supports a sheet metal member 134 and the mountings for the pivot pins 124 and 126. Thus, the bottom edges of the frame members 132 engage the stop bar 128 and support the platform section in the horizontal position.

The folding platform panels 120 and 122 are secured to each other by a hinge 136 and panel 120 is secured to panel 118 by another hinge 138 to enable such panels to fold on top of each other for storage in the vertical position beneath the cage base 88. Platform panel 122 is provided with a pair of flanges 140 which extend outwardly therefrom and engage the frame of the next adjacent main platform panel 118 for supporting the folding panels. A connector flange 142 is also provided on the folding section 122 and includes an aperture which extends over a post support stub 144 extending upwardly from one corner of each main platform panel 118.

As shown in FIG. 7, the post stub 144 is provided with a pair of notches 146 for engagement with a mounting pin 148 extending perpendicular through the bottom end of each of a plurality of posts 150 for anchoring such post in such stub. The top of the post 150 is provided with a chain mounting member 152 providing eyelets to which a plurality of sections of safety chain 154 are attached so that such chain extends around the periphery of the platform, the opposite ends of such chain being attached to the cage base 88 to completely enclose the platform.

In the example shown in FIG. 4, each of the sections of the platform formed by a main panel 118 and two folding panels 120 and 122 covers an angle of 45° measured about the longitudinal axis 39 of the cage. It should be noted that the last main panel 118A extending in a clockwise direction about the cage axis has no folding panels attached thereto. Otherwise, the remaining platform sections are identical.

It will be obvious to those having ordinary skill in the art that many changes may be made in the above described preferred embodiment of the present invention without departing from the spirit of the invention. For example, the cage can be used without the platform and vice versa. Therefore, the scope of the present invention can only be determined by the following claims:

We claim:

1. Apparatus for positioning a person within a container tank, comprising:

support means for supporting a person;

hoist means for raising and lowering a hoist member attached to said support means to move said support means to different vertical positions within said tank, said hoist member being mounted on bearing means for rotating the hoist member and support means within said tank on said bearing means, and for transporting said support means through a restricted opening in said tank;

support arm means for pivotally supporting said support means on said hoist member, said support arm means including a pair of support arms which are each attached to the hoist member by pivot means intermediate between the ends of such support arms;

control means, operable by the person on said support means, for causing said support arm means to pivot into different positions in order to change the distance between the support means and the hoist member, including a retracted position in which the support means is immediately adjacent the hoist member to enable the hoist means to transport said support means through said restricted opening.

2. Apparatus in accordance with claim 1 in which the control means includes a valve actuated cylinder means for pivoting said support arms.

3. Apparatus in accordance with claim 1 in which support arm means is attached to a counterweight means on the opposite end of the support arm means from that attached to the support means, and the support means includes a cage means for enclosing a person.

4. Apparatus in accordance with claim 3 in which the support means also includes a platform means surrounding said cage means and pivotally attached to said cage means for movement between a first position substantially parallel to the longitudinal axis of the cage in which the platform means fits through said restricted opening, and a second position substantially perpendicular to said cage axis.

5. Apparatus in accordance with claim 4 in which the platform means includes a plurality of first sections pivotally mounted on said cage means for movement into said first and second positions and spaced apart around said cage means, and a plurality of second sections hinged to one of said first sections for folding and unfolding of said second sections and adapted to be releasably connected to another of said first sections in said second position.

6. Apparatus in accordance with claim 1 in which the support means includes a plurality of platform sections, means for pivotally mounting said platform sections on said support means for pivoting between a first position substantially perpendicular to said hoist member, and means for releasably attaching said sections together in said second position.

7. Apparatus in accordance with claim 1 in which the hoist means including an upper hoist member extending through a bearing means which engages the perimeter of the opening in the tank for enabling the hoist member to rotate and to slide longitudinally through such bearing means, said hoist means also including a lower hoist member which is spaced laterally from the axis of said upper hoist member and is pivotally attached to said support arm means to enable the support means to be aligned with said axis in said retracted position.

8. Apparatus for supporting a person in different positions, comprising:

cage means for enclosing a person therein;

support arm means including an upper support arm and a lower support arm substantially parallel to said upper arm, for supporting said cage means at one end of said support arm means to maintain said cage means upright during pivotal movement of such support arms;

counter balance means attached to the other end of said support arm means;

hoist means for raising and lowering a hoist member attached to said cage means, said counter balance means and said support arm means to move said cage means to different vertical positions within said tank, said hoist member being mounted on bearing means for rotating said hoist member and cage means within said tank;

pivot means for pivotally mounting said support arm means on said hoist means at an intermediate portion of the upper and lower support arms between said cage means and said counter balance means; and control means for causing said support arm means to pivot on the hoist member into different positions in order to adjust the distance between the cage means and the hoist member while maintaining said cage means upright.

9. Apparatus in accordance with claim 8 in which the control means can pivot the support arm means into a retracted position substantially parallel with the hoist member, and the hoist means includes means for transporting the cage means and support arm means through a restricted opening in said retracted position.

10. Apparatus in accordance with claim 9 which includes a releasable lock means for locking the cage means to said hoist member in said retracted position.

11. Apparatus in accordance with claim 8 in which the counter balance means is a counter weight.

12. Apparatus in accordance with claim 8 in which the control means includes a valve actuated cylinder means for pivoting the support arm means in accordance with the operation of a valve control means on the cage means.

13. Apparatus in accordance with claim 8 in which the support arms are pivotally attached at their opposite ends to the cage means and the counter balance means and the pivot means includes a pair of pivots for pivotally mounting said support arms on said hoist member.

14. Apparatus in accordance with claim 12 in which the cylinder means includes a hydraulic cylinder connected to a high pressure water line through a pressure reducing valve, and means for connecting said water line to a high pressure water spray cleaning device for cleaning the interior of the tank.

15. Apparatus for positioning a person within a container tank, comprising:

support means for supporting a person;

hoist means for raising and lowering a hoist member attached to said support means and for transporting said support means through a restricted opening in said tank;

said support means including a plurality of platform sections, means for pivotally mounting said platform sections so they pivot between a first position substantially parallel to the hoist member and a second position substantially perpendicular to said hoist member, and means for releasably attaching said platform sections together in said second position;

support arm means for pivotally attaching said support means to said hoist member; and control means for causing said support arm means to pivot into different positions in order to change the distance between the support means and the hoist member, including a retracted position in which the support means is immediately adjacent the hoist member to enable the hoist means to transport said support means through said restricted opening.

* * * * *